US007223185B2

(12) United States Patent
Miller et al.

(10) Patent No.: US 7,223,185 B2
(45) Date of Patent: May 29, 2007

(54) HIDE-BEHIND BUNKER SYSTEM AND KIT WITH IMPACT DAMPENING ANCHORS

(76) Inventors: Craig M. Miller, 1511 Fox Grove, St. Lazare, P. Quebec (CA) J7T 2K3; John M. Call, 1695 Centerpoint Rd., Oak Hill, OH (US) 45656

( * ) Notice: Subject to any disclaimer, the term of this patent is extended or adjusted under 35 U.S.C. 154(b) by 240 days.

(21) Appl. No.: 11/093,209

(22) Filed: Mar. 29, 2005

(65) Prior Publication Data

US 2005/0187043 A1 Aug. 25, 2005

Related U.S. Application Data

(63) Continuation-in-part of application No. 10/285,950, filed on Nov. 1, 2002, now abandoned.

(51) Int. Cl.

| | |
|---|---|
| ***A63B 67/00*** | (2006.01) |
| ***A63C 19/00*** | (2006.01) |
| ***A63C 19/04*** | (2006.01) |
| ***A63J 3/00*** | (2006.01) |
| ***E01C 13/00*** | (2006.01) |
| ***E04H 3/10*** | (2006.01) |

(52) U.S. Cl. ..... 473/415; 472/92

(58) Field of Classification Search ..... 473/415; 472/92; 482/85–90

See application file for complete search history.

(56) References Cited

U.S. PATENT DOCUMENTS

| | | | | |
|---|---|---|---|---|
| 3,234,685 | A | 2/1966 | Harrowe | |
| 4,179,832 | A * | 12/1979 | Lemelson | 40/540 |
| 4,204,678 | A * | 5/1980 | Weis | 473/423 |
| 4,460,172 | A | 7/1984 | Hogan | |
| 4,478,587 | A * | 10/1984 | Mackal | 441/41 |
| 5,219,316 | A * | 6/1993 | Huffman | 472/62 |
| 5,330,403 | A | 7/1994 | Kuo | |
| 5,462,505 | A * | 10/1995 | Blair et al. | 482/27 |
| 5,522,757 | A * | 6/1996 | Ostrowski | 446/220 |
| 5,720,678 | A * | 2/1998 | Korthauer | 473/415 |
| 5,832,672 | A | 11/1998 | Griffiths | |
| 5,855,371 | A * | 1/1999 | Sanders | 273/349 |
| 5,868,637 | A | 2/1999 | Poxon | |
| 5,906,373 | A * | 5/1999 | Sanders | 273/349 |
| 5,937,586 | A * | 8/1999 | Scherba | 52/2.23 |
| 6,021,795 | A * | 2/2000 | Long et al. | 135/98 |
| 6,106,443 | A | 8/2000 | Kuo | |
| 6,251,033 | B1 | 6/2001 | Davidson | |
| 6,296,580 | B1 | 10/2001 | Hamet | |
| 2003/0060308 | A1 * | 3/2003 | Miller et al. | 473/415 |

* cited by examiner

*Primary Examiner*—Eugene Kim
*Assistant Examiner*—Alvin A. Hunter, Jr.
(74) *Attorney, Agent, or Firm*—Meroni & Meroni, P.C.; Charles F. Meroni, Jr.; Christopher J. Scott

(57) ABSTRACT

A hide-behind bunker system and kit for enabling a user to take cover behind at least one stand-alone, impact dampening structure. The system comprises at least one inflatable hide-behind structure cooperatively associated with an impact dampening anchor system. The hide-behind structure comprises an inferior bunker end, an opaque outer bunker surface, a matter-retaining inner bunker surface, and air inlet-outlet structure. The inner bunker surface defines an inner structure volume for receiving and retaining structure-erecting air. The impact dampening anchor system or assembly is attached to and extends outwardly from the outer bunker surface adjacent the inferior bunker end. The anchor system comprises at least three elastic link anchor assemblies, which assemblies each comprise a looped elastic member. The elastic member functions to absorb certain bodily impact when users collide therewith. The system and kit thus enable a user to take cover behind at least one stand-alone, impact dampening structure.

20 Claims, 6 Drawing Sheets

HIDE-BEHIND BUNKER SYSTEM AND KIT WITH IMPACT DAMPENING ANCHORS

PRIOR HISTORY

This application is a U.S. Continuation-in-Part Patent Application claiming the benefit of U.S. Continuation-in-Part patent application Ser. No. 10/285,950, filed Nov. 01, 2002 now abandoned, which application claims the benefit of lapsed U.S. patent application Ser. No. 09/684,288, filed Oct. 6, 2000.

FIELD OF THE INVENTION

The present invention relates to an inflatable bunker and anchoring system, and, more particularly, to a stand-alone inflatable bunker in combination with an impact dampening anchor system for improved shock absorption during a collision.

BACKGROUND OF THE INVENTION

Simulated war games have been carried out by military personnel and civilians for many years for training and entertainment purposes. In order to carry out these simulations safely and effectively, players engage one another while donning protective gear and equipped with war-simulative weaponry, such as paintball guns, paint pellet guns, laser guns, and/or water guns. These games or simulations may be carried out in a variety of settings or arenas. Often times, such exercises are performed in heavily wooded areas or forests where players can hide behind trees and camouflage themselves to blend in and not be detected by the opposing players. The exercises may easily be carried out on outdoor or indoor fields or arenas designed with any number of artificial bunkers to otherwise provide cover for players to avoid being targeted and thus "hit" with war-simulative ammunition, such as paintballs, paint pellets, lasers, water, and the like.

The growing popularity of such sporting activity is reflected in the continued development of games, systems, and apparatuses as further reflected in a number of patent disclosures made to the United States Patent and Trademark Office. For example, the reader is directed to U.S. Pat. No. 5,855,371 ('371 patent), which issued to Sanders, and discloses a Water Targeting Game. The '371 patent teaches a water targeting game comprising three major elements, namely, a targeting vest, a water gun, and an obstruction maze wherein the game is played. The targeting vest includes a front vest and a back vest that are joined together at their upper peripheral edge by a pair of adjustable shoulder straps and that are adjusted at a person's waist by a pair of waist straps. Between the two vests is a cavity and on the front section of the vest, is located a plurality of water collecting openings that serve as targets. When playing the game, the water gun emits a stream of water that is aimed at the openings from where the water falls into the cavity. The water collected in the cavities is viewed through a sealed vertical window that is also located on the vest's front section. Notably, the '371 patent further teaches an obstruction maze constructed of an air inflatable structure that is maintained in an inflatable configuration by a continuous flow of air. In this last regard, the reader is directed to FIG. 12 of the '371 patent.

U.S. Pat. No. 5,906,373 ('373 patent), which also issued to Sanders, discloses a Water-Tag Game Played within a Maze. From an inspection of the '373 patent, it will be seen that disclosed is a maze structure having an outer perimeter wall enclosing a plurality of sections and protrusions. An opening in the maze structure functions to admit players armed with water guns. Once inside the maze structure, the players circulate among the sections and the protrusions, firing their water guns at one another. The maze structure is inflated when the game is being played and may be deflated for storage or transportation.

U.S. Pat. No. 6,296,580 ('580 patent), which issued to Hamet, discloses Adaptable Playing Fields with Ventilated Structures. The '580 patent teaches paintball playing fields characterized by envelope elements fastened together creating a continuous interior volume filled with air, under a predetermined air pressure. A motor furnishes air to compensate for losses of pressure in the elements of the field. As noted by the '580 patent, artificial paintball obstacles, in the form of inflatable structures, may typically be inflated at the beginning of a game and placed strategically in previously chosen positions. The main inconvenience of inflatable paintball obstacles, as noted by the '580 patent, is their weight. In order to be airtight (and thus inflatable), thick material like tarpaulin is necessary, with welded or vulcanized seams between the different obstacles. The obstacles, as a whole, are therefore heavy, expensive, and difficult to repair during use. The '580 patent thus attempts to overcome the noted disadvantages by providing a ventilated paintball playing field characterized by empty envelope elements fastened together to create a continuous interior volume filled with air under a predetermined pressure, and a means to compensate for any loss of pressure.

It will thus be seen that the prior art provides an envelope or manifold structure along the entire periphery of a playing field having air feed tubes extending out therefrom and into various ventilated obstacles or ventilated bunkers. Air is typically fed into the manifold and supplied to the bunkers through the feed tubes by a remotely placed fan or blower and thus a certain air pressure is maintained within the manifold system. The system, however, is cumbersome to setup, noisy, and inconvenient. In order to properly function, the manifold, feed tubes, and bunkers have to be connected to one another (e.g. by zipper means) so as to provide a continuous interior volume. Players engaged in the activity, however, are highly mobile and thus often trip over feed tubes while carrying out combat exercises. Moreover, the noise from the fan and generator is a constant nuisance. Further, the bunkers or obstacles tend to quickly deflate upon deactivation of the pressure maintenance means or when the deactivation means become otherwise disconnected from the manifold system. Further, Hamet's fan-driven systems are made of very lightweight fabrics and are therefore prone to tearing under the players foot traffic, and rapidly deteriorate through normal usage. Ultraviolet electromagnetic energy further wreak havoc on the fabrics in a matter of several months exposure. Further, the Hamet seams are sewn and taped in practice. These seams necessarily leak, causing the need for constant inflation.

A further drawback associated with this and other inflatable or ventilated obstacle or bunker designs is that the inflatable or ventilated obstacles or bunkers are secured or anchored to the ground by way of non-elastic fastening means such as steel cables or ropes. To anchor or secure the obstacles to the ground, the non-elastic cables or ropes are typically threaded about the inflatable or ventilated obstacle, and then extended downward towards an anchor or anchor-enabling means. The anchor or anchor-enabling means may be in the form of at least one stake driven though at least one stake-receiving structure, which stake-receiving structure may be integrally formed with the inflatable or ventilated obstacle (e.g. an eyelet) or be a separate structure cooperatively associated with the inflatable or ventilated obstacle. The stakes may be driven into the ground and the non-elastic cables or ropes may then secured to the stakes. By thus staking the inflatable or ventilated obstacle to the ground, it will be readily understood that the inflatable or ventilated obstacle may thus be firmly secured or anchored to the ground. Alternativley, the stakes may be driven through stake-receiving eyelets or the like, which stake-receiving eyelets are typically formed from non-elastic materials so as to provide more stable anchoring means. In either event, it will be seen that the inflatable or ventilated obstacles or bunkers may be rigidly affixed or anchored to the ground.

However, rigidly affixing or anchoring the inflatable or ventilated bunkers or obstacles to the ground has proven to be a safety hazard in paintball playing fields. For example, when players collide with or impact upon rigidly anchored inflatable or ventilated bunkers or obstacles, the aforementioned anchoring systems tend to hold the inflatable or ventilated bunker or obstacle stationary. A player's collision or impact upon a stationary bunker or obstacle results in increased forces (via drastically increased deceleration) upon a player's body, which forces may cause discomfort or injury to the player. This absolute resistance results in an instantaneous cessation of movement (large, damage-inflicting negative acceleration), which in turn can cause great bodily harm.

Notably, elastic anchoring means are disclosed in somewhat related art. In this regard, the reader is directed to U.S. Pat. No. 6,021,795 ('795 patent), which issued to Long et al., and which discloses a Quick-Erecting Tent. The '795 patent teaches a quick-erecting tent comprising a collapsible frame and a canopy that is slidably connected to a frame. When the tent is erected, male and female structures will mate. These structures can be fastened together to prevent the tent from collapsing inadvertently. Stake rings are attached to the canopy using an elastic connection. In this last regard, the '795 patent teaches elastic span 44A as may be seen from an inspection of FIG. 13B. Elastic span 44A can be disposed at each corner of a tent between a tent support leg-receiving opening 45 and a stake-receiving ring 47. This design permits the bottom end of each tent support leg 36 a modest degree of movement even though the tent corners may be otherwise staked in place. This design then contemplated that elastic spans 44A function to ease a user's efforts with which the tent may be erected and collapsed.

It will be seen from an inspection of the '795 patent, however, that elastic spans 44A do not function to withstand impact from persons or other matter colliding therewith or impacting thereupon. Rather, elastic spans 44A function to allow a degree of "wiggle room" at the regions adjacent the ground interface of the tent support legs so that installation (or collapsing) of the tent may be achieved with greater ease. It will be further noted that tent passersby typically do not collide with or otherwise impact upon tent walls and thus elastic spans 44A are not designed to withstand bodily impact of passersby or of persons deliberately colliding with the tent walls.

It will thus be seen that the prior art needs an inflatable or ventilated bunker or obstacle system comprising individual, stand-alone inflatable or ventilated bunkers or obstacles, which bunkers or obstacles may be elastically anchored to the ground so that players moving (often with great momentum) around the bunkers or obstacles may more safely collide or impact the elastically anchored bunkers or obstacles. In this regard, it is contemplated that impact-resistant, stand-alone inflatable (or ventilated) bunkers or obstacles are to be preferred over continuous obstacles systems. It will be recalled that continuous obstacle systems comprise path-obstructing structures, which often cause players to trip or become injured while traveling at rapid speeds in and around obstacle laden playing fields. Further, it will be recalled that impact-resistant or elastically anchored obstacles or bunkers are to be preferred over rigidly-anchored obstacle or bunker installations. It will be noted that playing fields situated in wooded areas necessarily comprise a great number of rigidly-anchored obstacles (i.e. trees). However, in this regard, it will be further noted that portable, temporary (artificial) playing fields may often preferred to playing fields situated in wooded areas for any number of reasons, not the lease of which is safety as heretofore described. Trees are rigid obstacles. Players impacting upon trees are often injured in the process. Further, trees are relatively permanently fixed in the growing area and provide no portability (under normal circumstances). Other shortcomings will readily be understood by those skilled in the art and thus it is believed that an exhaustive listing of the advantages of artificial playing fields over natural playing fields is not necessary.

Thus, it will be seen that the prior art perceives a need for self-contained manifold-free inflatable or ventilated bunker for use in a paintball, airsoft or projectile sports arena or playing field to provide a safe playing field for players. The prior art further perceives a need for an inflatable or ventilated bunker (or obstacle) and impact dampening anchor system that is portable, easy to use and does not require a constant supply of air to remain inflated. Further, the prior art perceives a need for an inflatable or ventilated bunker (or obstacle) and impact dampening anchor system combination to absorb the impact forces resulting from player collisions so as to minimize bodily injury. The prior art further perceives a need for an inflatable or ventilated bunker system kit that provides all of the necessary equipment to erect a playing field in one package.

Therefore, it is an object of the present invention to provide a self-contained manifold-free inflatable bunker for use in a paintball, airsoft or projectile sports arena or playing field to provide a safe hiding place for players. It is another object of the present invention to provide an inflatable bunker and impact dampening anchor system that is portable, easy to use and does not require a constant supply of air to remain inflated. It is yet another object of the present invention to provide an inflatable bunker and impact dampening anchor system combination to absorb the forces of an impact during a collision to minimize bodily injury. In this regard, it is contemplated that the current inflatable bunker systems is constructed from relatively heavy Ultraviolet (UV)-resistant fabrics which endure abuse and abrasion from normal wear and tear. Further, the seams are welded with hot air, literally melting the bonded seams which are then press-rolled together while molten. This seam sealing system is superior to zippered and taped seaming as taught by the Hamet disclosure(s).

It is yet another object of the present invention to provide an inflatable bunker system kit that provides all of the necessary equipment to erect a playing field in one package. Other objects and features will become readily apparent when the disclosure is read in combination with the drawings and appended claims.

SUMMARY OF THE INVENTION

What is disclosed is, in combination, a stand-alone inflatable bunker and an impact dampening anchor system to provide cover for athletes players engaged in sporting activity upon a paintball, airsoft or projectile field, which system comprises, in combination, an impact dampener having a first and second end, an inflatable bunker having an inner and outer surface, the inner surface defining a bunker cavity for air containment, a two-way valve extending from the inner surface to the outer surface for inflation and deflation of the cavity, a handle attached to and extending outwardly from the outer surface of the bunker affixed to the first end of the impact dampener, and an anchor adapter connecting the second end of the impact dampener to a stationary ground anchor.

In the preferred embodiment, the impact dampener comprises bungee cord structure. It is contemplated, however, that the impact dampener may also comprise coil spring structure, or bands formed of elastic material, such as rubber and the like, or any combination of the foregoing.

In one embodiment, the inflatable bunker further comprises a pressure relief valve extending through the inner and outer surfaces for releasing air when the internal pressure of the bunker cavity exceeds a predetermined pressure.

In yet another embodiment, the inflatable bunker further comprises a removably affixed weighted base, the weighted base being removably affixed by mating fasteners. The weighted base essentially comprises an inner base surface and an outer base surface, the inner base surface defining a base cavity for containing weighting material. A fill/drain port extends from the inner base surface to the outer base surface for filling and draining the base cavity with the weighting material. It is contemplated that the weighting material may preferably comprise sand. However, the weighting material may further comprise water, soil, pea gravel, or any sufficiently weighty material (or a combination of the foregoing) that may be place into or removed from the base cavity through the fill/drain port. The mating fasteners may preferably be defined by mating VELCRO® brand hook and loop fastening means, which means may function to removably affix the inflatable bunker to the weighted base. It is further contemplated, however, that the mating fasteners may further be defined by comprising a plurality of mating snaps, buckles and corresponding straps, or buttons and slots.

It is contemplated that the stationary ground anchor may be defined by a ground-piercing stake formed from rigid materials, which stake comprises an elongated shaft and a head. The anchor adapter may comprise an adapter body, which adapter body further comprises proximal and distal adapter body ends. A connector on the proximal adapter body end attaches to a second end of the impact dampener, and a grommet provides an opening on the distal adapter body end. The grommet has a stake-receiving aperture, the transverse dimensions of which are slightly greater than the transverse cross-sectional dimensions of the stake shaft, but lesser than the transverse cross-sectional dimensions of the stake head so as to prevent the anchor adapter from disengaging the stationary ground anchor.

The stationary ground anchor may comprises a weighted base having an inner and outer surface, the inner surface defining a base cavity for containing weighting material, a fill/drain port extending through the inner and outer surface for filling and draining the base cavity, and wherein the anchor adapter comprises a base handle affixed to and outwardly extending from the outer surface of the weighted base, the base handle affixed to the second end of the impact dampener.

In yet another embodiment, the system may comprise a stand-alone inflatable bunker and impact dampening anchor system designed to provide cover for players or athletes engaged in sporting activity upon a paintball, airsoft or projectile field comprises. The system may thus be further defined by an inflatable bunker. The inflatable bunker comprises an inner bunker surface and an outer bunker surface, the inner bunker surface defining a bunker cavity for air containment. A two-way valve extends through the inner bunker surface and the outer bunker surface so as to enable inflation and deflation of the bunker cavity. Further, a pressure relief valve extends through the inner bunker surface and the outer bunker surface for releasing air when the internal pressure of the cavity exceeds a predetermined pressure. A weighted base is further contemplated, which weighted base comprises an inner base surface and an outer base surface. The inner base surface defines a base cavity for containing sand. A matter-receiving port extends through the inner base surface and the outer base surface for allowing a user to fill and/or drain the base cavity. The weighted base may be removably affixed to the inflatable bunker by mating fasteners.

It is further contemplated that another aspect of the invention teaches an inflatable bunker obstacle field kit. In other words, a plurality of inflatable bunkers can be combined to provide an inflatable bunker obstacle field kit. The kit essentially comprises a container sized and shaped to hold a plurality of inflatable bunkers with a plurality of inflatable bunkers within the container having a plurality of shapes and sizes for creating a paintball, airsoft or projectile field. A plurality of impact dampeners are attached to each of the inflatable bunkers. A plurality of anchor adapters are cooperatively associated with or are moveably connected to the impact dampeners so as to provide means for a plurality of weight bags to be connected to the impact dampeners. The anchor adapters each have an aperture sized and shaped to receive a stake. The kit includes a portable blower for cumulatively inflating the inflatable bunkers prior to use of the inflatable bunkers.

BRIEF DESCRIPTION OF THE DRAWINGS

Other features of my invention will become more evident from a consideration of the following brief description of my patent drawings, as follows.

DETAILED DESCRIPTION OF THE PREFERRED EMBODIMENT(S)

Figure 1:
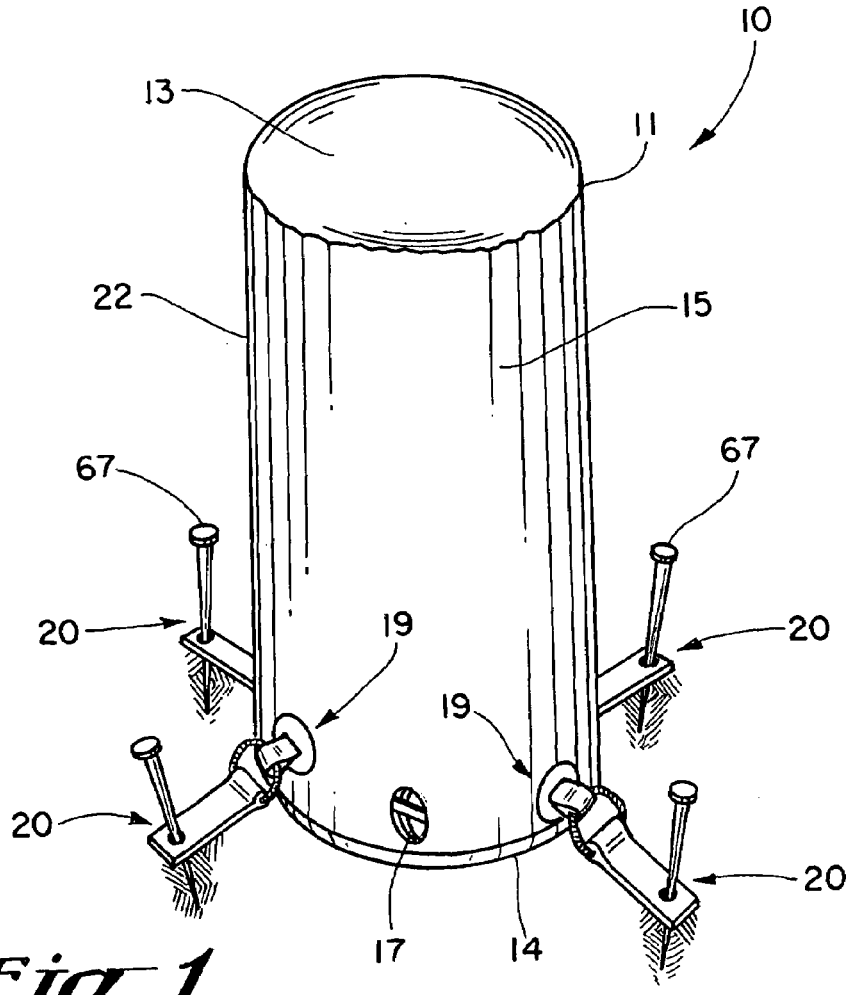
FIG. 1 is a perspective view of a hide-behind bunker assembly comprising an inflatable hide-behind structure and an impact dampening anchor system.

Referring now to the drawings, the preferred embodiment of the present invention concerns a stand-alone, impact-dampening, sight-obstructing shield or hide-behind bunker assembly 10 as illustrated and referenced in FIGS. 1, 4–6, and 10. Hide-behind bunker assembly 10 comprises a hide-behind structure 11 as illustrated and referenced in FIGS. 1, 2, 4–8, and 10; and impact dampening anchor means for anchoring hide-behind structure 11 to a ground playing surface 12 so as to resist structural impact or for impact dampening purposes. In this last regard, it is noted that an impact dampener functions to lessen or otherwise decrease the magnitude of negative accelerative forces inherent in a player's impact with a stationary object. Ground playing surface 12 is generally referenced in FIGS. 4 and 10. In this regard, it will be noted that players attempting to avoid being hit by war-game ammunition, be it paintballs, lasers, or water, or other non-lethal ammunition means, will typically attempt to hide behind structure until opponents discover their position. When an opponent discovers a player's hidden position, attempts are typically made by the opponent to maneuver into positions so that the player may be more properly targeted. The player, in an effort to avoid being hit, will then be required to relocate, often quite quickly. A player's resulting velocity and body mass both contribute to the player's momentum. Should the player collide with an object, forces are exerted against the player by the object and forces are exerted against the object by the player. Rigidly affixed objects may thus injure the player given sudden decelerations by the player against the otherwise fixedly anchored obstacles or hide-behind structures. The present invention thus contemplates hide-behind structures 10 that incorporate the use of impact dampening anchor means so as to address safety concerns otherwise associated into collisions with fixed objects. Further, it is contemplated that the current inflatable bunker system is constructed from relatively heavy Ultraviolet (UV)-resistant fabrics which endure abuse and abrasion from normal wear and tear of typical paintball playing fields. Further, the seams are welded with hot air, literally melting the bonded seams which are then press-rolled together while molten. This seam sealing system is superior to zippered and taped seaming as taught by the Hamet disclosure(s).

Figure 2:
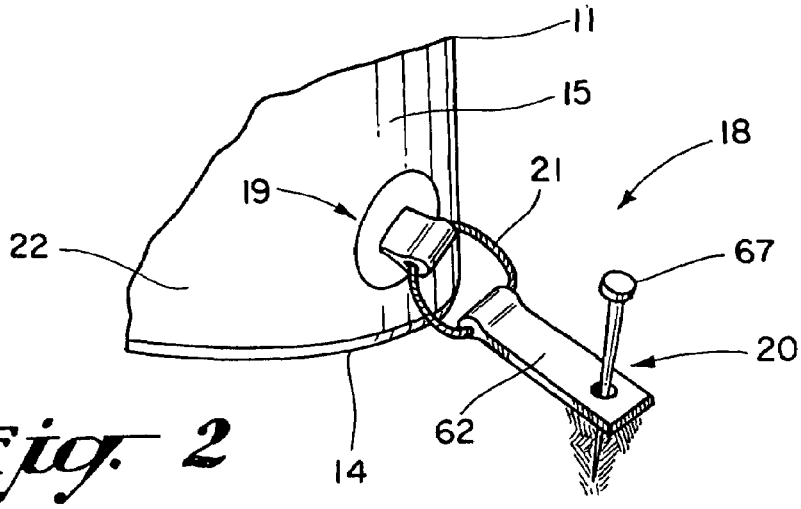
FIG. 2 is an enlarged fragmentary perspective view of an elastic link anchor assembly adjacent the inferior bunker end of the hide-behind structure.
Figure 3:
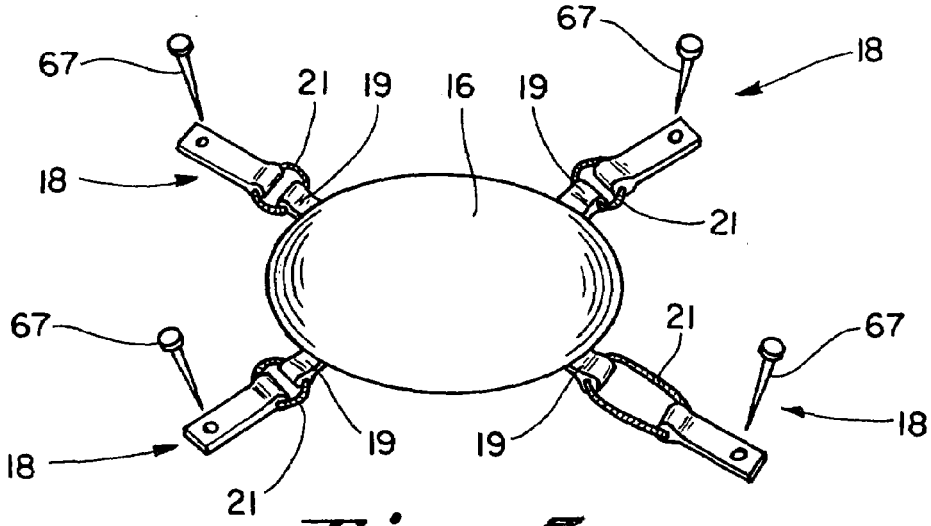
FIG. 3 is a fragmentary perspective view of the inferior bunker end with attached impact dampening anchor.
Figure 4:
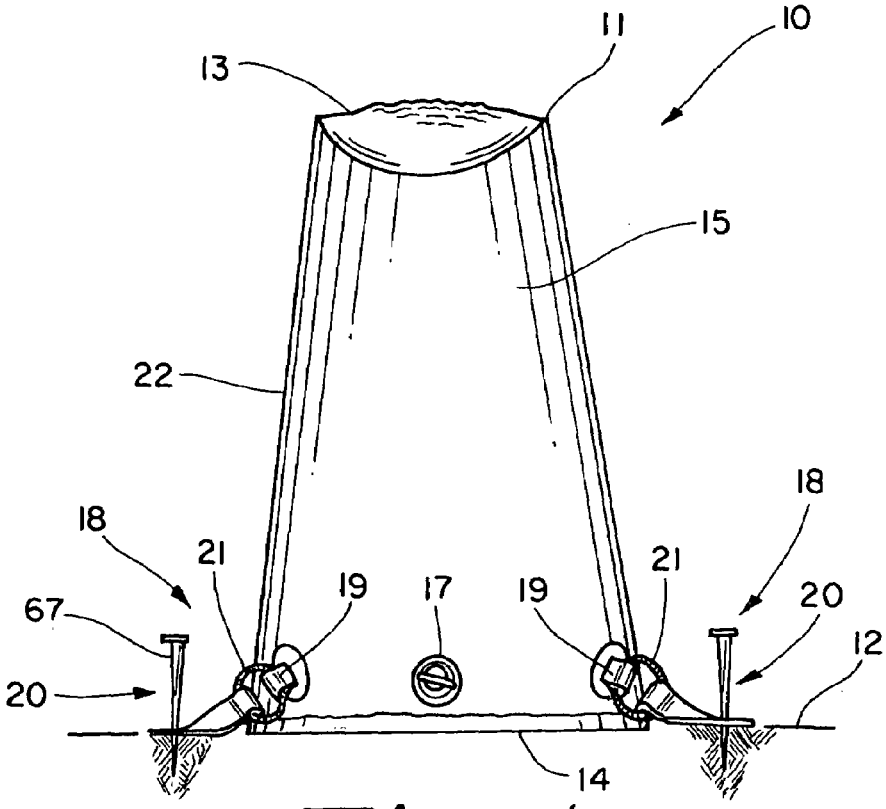
FIG. 4 is a side view of the hide-behind bunker assembly comprising an inflatable hide-behind structure and impact dampening anchor system.
Figure 5:
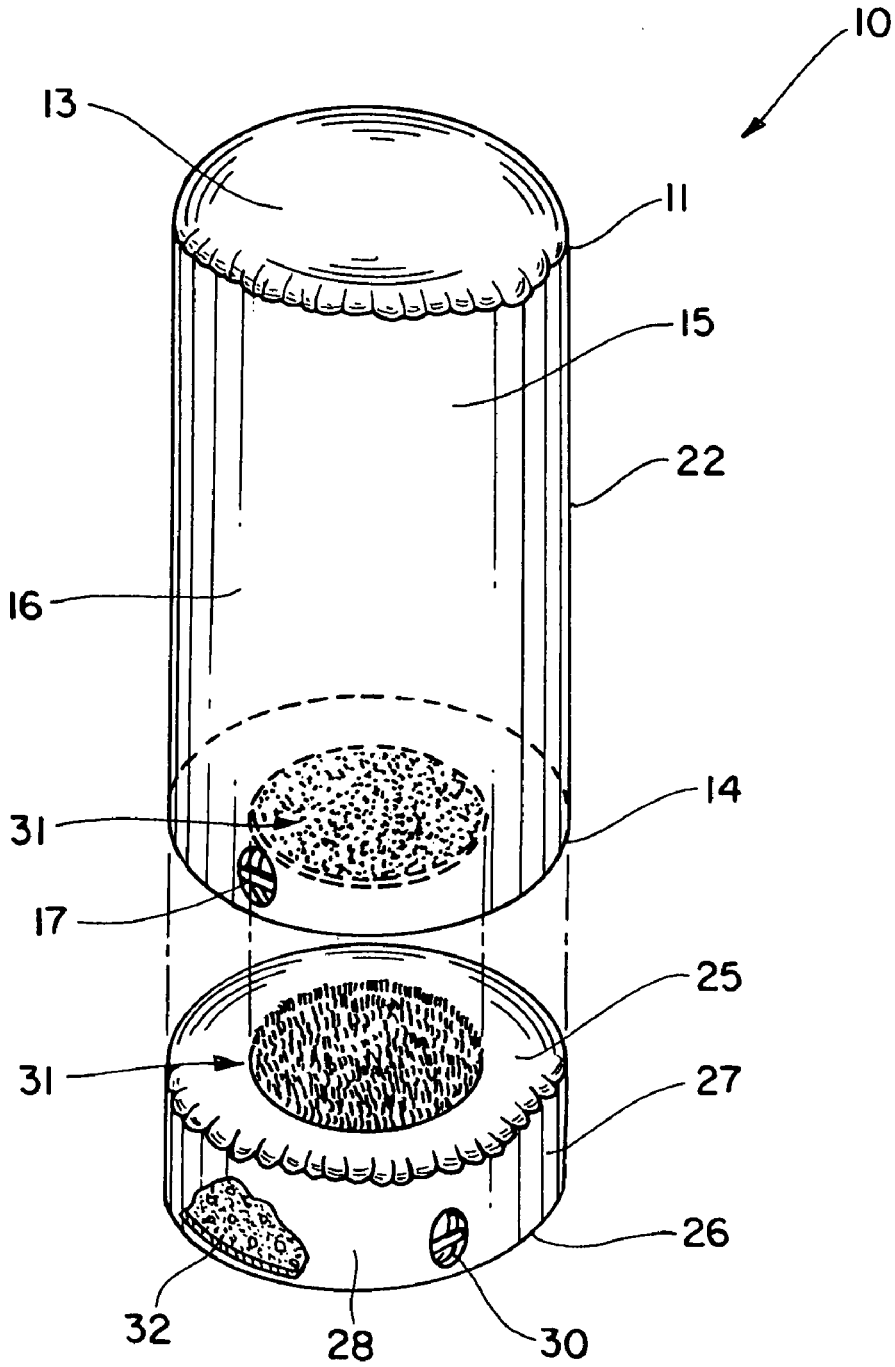
FIG. 5 is a perspective view of a first alternative embodiment of the hide-behind bunker assembly.

Hide-behind structure 11 preferably comprises a superior bunker end 13 as illustrated in FIGS. 1, 4–6, and 10; an inferior bunker end 14 as illustrated and referenced in FIGS. 1–8; bunker end-joining structure 22 as illustrated in FIG. 1, 2, 4–8, and 10, an opaque outer bunker surface 15 as illustrated and referenced in FIGS. 1, 2, 4–8, and 10; a matter-retaining inner bunker surface 16 as illustrated and referenced in FIGS. 3 and 5; and bunker matter inlet-outlet means as generally referenced at 17 in FIGS. 1, 4–6, and 8. Outer bunker surface is preferably opaque or non-transparent as a means to otherwise obstruct an onlooker's line of sight. Bunker end-joining structure 22 functions to integrally join superior bunker end 13 to inferior bunker end 14 and inherently comprises a transverse cross-sectional inferior end configuration, which inferior end configuration inherently comprises an inferior end periphery. From an inspection of FIG. 3, it will be seen that the inferior end configuration (as depicted) is generally circular and thus the inferior end transverse cross-section or inferior end periphery is also generally circular (as depicted).

From Inner bunker surface 16 essentially defines a matter-receiving inner structure volume. It is contemplated that in the preferred embodiment, the matter-receiving inner structure volume is designed to receive air and thus it is contemplated that in the preferred embodiment hide-behind structure 11 may be inflated, inner bunker surface 16 thus being impervious to air. It is contemplated that other matter may also be used to otherwise fill the matter-receiving inner structure volume, such as any of the inert gases, non-volatile liquids, or even solid material. It is further contemplated, however, that atmospheric air is the preferred material that may be utilized to occupy matter-receiving inner structure volume. By filling the matter-receiving inner structure volume with air (or other gas), inner bunker surface 16 tends to expand outwardly under the associated gaseous pressure and thus the matter-receiving inner structure volume is maximized. When the matter-receiving inner structure volume is maximized, outer bunker surface 15 provides sight-obstructing structure.

In the preferred embodiment, it is contemplated that outer bunker surface 15 is similarly sized and shaped as inner bunker surface. However, outer bunker surface 15 may comprise varying sizes or shapes (as compared to inner bunker surface 16) as a means to provide varied sight-obstructing structure. In this regard, the user may wish that hide-behind structure resemble a tree. Inner bunker surface may thus be cylindrically shaped (akin to a tree trunk) and outer bunker surface 15 may be tree shaped (cylindrical trunk with branches or the like). The interstices between inner bunker surface 16 and outer bunker surface 15 may thus be filled padding or similar other impact-resistant or impact-dampening material (e.g. foam rubber). In this manner, outer bunker surface 15 may thus comprises a significantly larger surface area than inner bunker surface 16. Thus, it will be noted that inner bunker surface inherently has an inner surface area (bounding the matter-receiving inner structure volume) and the outer bunker surface 15 inherently has an outer surface area (i.e. an atmospheric volume displacing volume), the outer surface area being substantially greater in magnitude than the inner surface area. Thus, it will be readily understood that while outer bunker surface 15 and similarly configured inner bunker surface 16 of hide-behind structure 11 are each depicted in generic cylindrical form for illustrative purposes, outer bunker surface 15 and inner bunker surface 16 (and thus hide-behind structure 11) may be constructed in a variety of shapes. Such shapes may include, but are not limited to, spherical, conical, pyramidal, rectangular, cubical or any combination thereof. In this regard, it will thus be understood that the inferior end configuration may comprise circular, rectangular (square), or triangular inferior end transverse cross-sections or peripheries as the case may be.

The bunker matter inlet-outlet means as referenced at 17 may preferably be defined by a two-way valve for selectively inletting bunker matter and for selectively outletting bunker matter, when air or other gaseous substances are utilized as the means for maximizing the matter-receiving inner structure volume. The two-way valve thus preferably extends from outer bunker surface 15 to inner bunker surface 16 and enables users to inflate or deflate the matter-receiving inner structure volume as may be required (e.g. inflating hide-behind structure 11 during setup or deflating hide-behind structure 11 during takedown). Additionally, the bunker matter inlet-outlet means may comprise pressure relief means (not specifically illustrated), which means extend from outer bunker surface 15 to inner bunker surface 16 and function to prevent the matter-receiving inner structure volume from becoming too great and perhaps structurally compromising the otherwise air-impermeable inner bunker surface 16. Thus, the pressure relief means may function to prevent over-inflation of hide-behind structure 11 or further may function to prevent structural damage to hide-behind structure. In this last regard, it is contemplated that a player may impart additional forces against hide-behind structure 11 such as by squeezing hide-behind structure 11 or by falling upon hide-behind structure 11. Given an internal pressure that is greater than the predetermined pressure point for the pressure relief means, it is contemplated that the pressure relief means will function to relieve the excessive pressure by allowing bunker matter to outlet from inner bunker surface 16 to areas adjacent outer bunker surface 15. In other words, the pressure relief means will protect hide-behind structure from damage by releasing air when the internal air pressure of the matter-receiving inner structure volume exceeds a predetermined pressure point.

Thus, in the preferred embodiment, inner bunker surface 16 (being an air-receiving bladder) may be constructed of any flexible, resilient, and airtight material such as plastic, rubber and the like so that once filled with air, it may remain inflated for extended periods of time. Further, in a preferred embodiment, outer bunker surface 15 is constructed from polyurethane. The intersticial matter, if any, may comprise foam rubber or other similar material as previously specified. Panels of various shapes are preferably heat-sealed together to form the aforementioned three-dimensional shaped bunkers.

As earlier specified, hide-behind structure 11 is anchored to ground playing surface 12 via any number of impact dampening anchor means. Preferably, the impact dampening anchor means are defined by comprising a plurality of elastic link anchor assemblies 18 as illustrated and referenced in FIGS. 1–4, and 7. Elastic link anchor assemblies 18 each preferably comprise a bunker link assembly 19 as further referenced in FIGS. 1–4, 7, and 8; a playing surface link assembly 20 as further referenced in FIGS. 1–4, and 7; and an elastic link member 21 as further referenced in FIGS. 1–4, 7, and 8. Elastic link members 21 functions to elastically link the bunker link assemblies 19 to the playing surface link assemblies 20 as may be seen from a general consideration of the noted figures. It will be further seen that a plurality of elastic link anchor assemblies 18 are preferably spaced about bunker end-joining structure 22 adjacent inferior bunker end 14 such that the distance or arc length intermediate adjacent elastic link anchor assemblies 18 is maximized. For example, given a circular inferior end transverse cross-section (as depicted), it is contemplated that at least three (3), but preferably four (4) elastic link anchor assemblies be circumferentially spaced such that 90 rotational degrees and the associated arc lengths preferably extend between or intermediate adjacent elastic link anchor assemblies 18. Given at least three adjacent elastic link anchor assemblies 18, it is contemplated that 120 rotational degrees and the associated arc lengths extend intermediate adjacent elastic link anchor assemblies 18. Given a rectangular or triangular inferior end transverse cross section, it is contemplated that adjacent elastic link anchor assemblies 18 are preferably located at the corners.

Each bunker link assembly 19 preferably attaches to and extends outwardly from outer bunker surface 15, and may either be integrally formed during the construction of hide-behind structure 11, or affixed thereto after hide-behind structure 11 has been partially or fully constructed. As may be seen from a general inspection of FIG. 7, bunker link assembly preferably comprises a bunker link member 43 and a bunker ring 45. Bunker link member 43 and bunker ring 45 are heat welded, bonded, glued, or stitched to outer bunker surface 15 of hide-behind structure 11 substantially as shown. Ends 43*a* and 43*b* of bunker link member 43 are heat welded, bonded, glued or stitched to hide-behind structure 11 intermediate outer bunker surface 15 and a bunker-engaging surface (not shown) of bunker ring 45. Central portion 43*c* of strap 43 extends outwardly from outer bunker surface 15 of hide-behind structure 11, and extends through aperture 45*a* of bunker ring 45 to form loop 47. Notably, the longitudinal axis of loop 47 is preferably orthogonal to the longitudinal axis of bunker ring 45.

Figure 7:
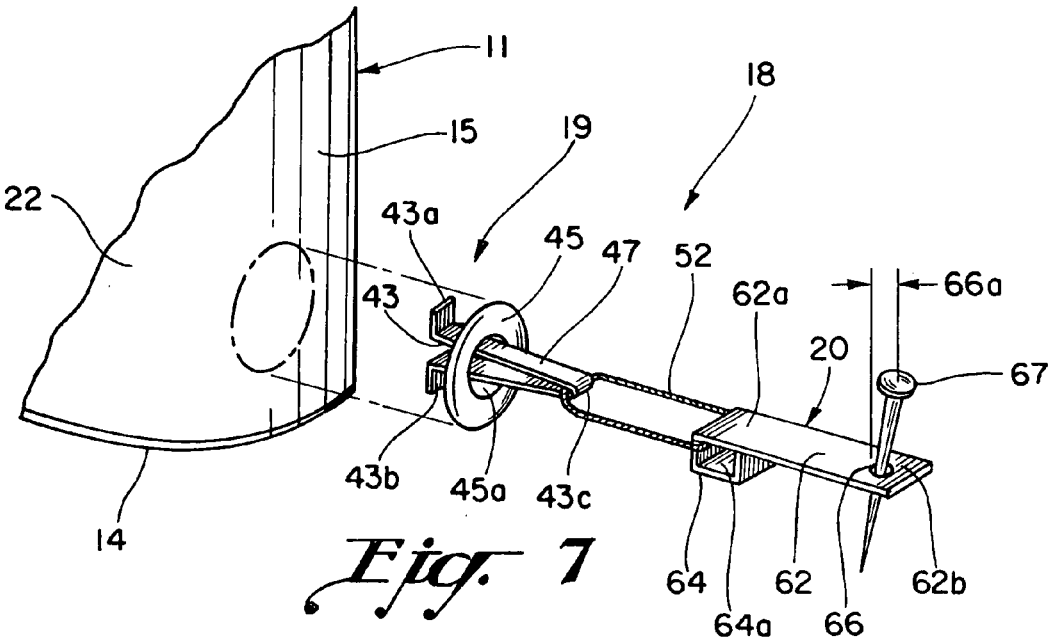
FIG. 7 is a fragmentary exploded perspective view of an elastic link anchor assembly adjacent the inferior bunker end of the hide-behind structure.

Each playing surface link assembly 20 preferably comprises an adapter body 62 as illustrated and referenced in FIGS. 2 and 7; and a playing surface-piercing stake 67 as illustrated and referenced in FIGS. 1–4, and 7. Adapter body 62 preferably comprises a proximal end region 62*a* and distal end region 62*b*. Proximal end region 62*a* further comprises connector link structure 64 to secure a distal end of elastic link member 21. Thus, connector link structure 64 preferably comprises an adapter loop 64*a*. The longitudinal axis of adapter loop 64(*a*) is preferably substantially parallel to the longitudinal axis of loop 47. Distal end region 62*b* further comprises grommet or weighted eyelet 66 through which a playing surface-piercing stake may pass as it is driven into ground playing surface 12. The inner diameter 66*a* of the grommet is slightly larger than the outer diameter of the stake shaft, yet smaller than the outer diameter of the stake head to prevent the stake from fully passing therethrough. It is contemplated that similar considerations would also apply for transverse cross-sections other than circular transverse cross-sections and thus no further descriptions are necessary, as it is well within one of ordinary skill in the art to substitute square shaft stakes for circular shaft stakes and the like.

Elastic link member 21 is preferably constructed from a stretchable material to absorb energy (decrease the magnitude of acceleration/deceleration vectors) from an impact. In a preferred embodiment, elastic link member is a looped or ringed bungee cord 52. Looped or ringed bungee cord 52 thus lies within a single plane when in an initial equilibrium state (i.e. before impact) and comprises a bunker loop-engaging portion (proximal end), an anchor loop-engaging portion (distal end), and two laterally-opposed impact-absorbing lengths 52 substantially as illustrated and referenced in FIG. 7. The bunker loop-engaging portion is substantially parallel with the longitudinal axis of loop 47; the anchor loop-engaging portion is substantially parallel with the longitudinal axis of adapter loop 64(*a*); and, as indicated, the impact-absorbing lengths are coplanar with the loop-engaging portions when the system is in a relaxed, non-impact state. The plane in which ringed bungee cord lies is then substantially parallel to or coplanar with the longitudinal axes of loop 47 and adapter loop 64(*a*). The bunker loop-engaging portion thus passes through loop 47, and is secured to connector link 64 of playing surface link assembly 20 to form the preferred impact dampening anchor means of the present invention. Alternatively, elastic link member 21 may comprise a rubber band, an elastic band, or other spring member that is secured between in similar fashion through loop 47 and connector link 64.

Excellent results have been obtained when bungee is incorporated into the design of elastic link member 21. It will be noted that bungee is used in certain sport activities, commonly referred to as "bungee jumping," which sporting activity involves fastening a first end of a relaxed length of bungee cord to a fixed overhang and a second end of the relaxed length of bungee cord to a user's body. The user then "jumps" from the overhang and the bungee cord reverses the user's acceleration in free fall when the relaxed length is exceeded. The reverse acceleration is achieved over a longer time period as opposed to an instant reverse acceleration (as would be the case if steel cable were used instead of bungee), and thus the jumper is typically able to walk away from the experience unharmed. It is with these notions in view that the preferred embodiment of the present invention contemplates an elastic link member constructed from or comprising bungee type materials. It should be further noted that laterally-opposed impact-absorbing lengths are to be preferred over a single bungee length. The ringed elastic link member is central to the described impact dampening anchor means in that twice the impact dampening function is achieved with the same material.

Alternative Embodiment(s)

Figure 6:
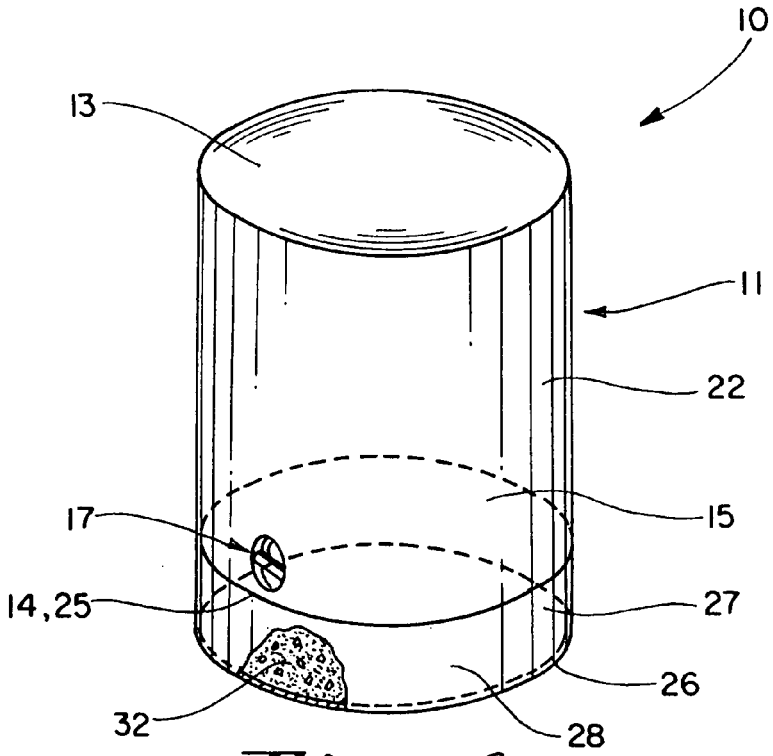
FIG. 6 is a perspective view of a second alternative embodiment of the hide-behind bunker assembly.

In an alternative embodiment, as generally depicted in FIG. 5, hide-behind structure 11 is cooperatively associated with a weighted base member 24. In this regard, weighted base member 24 preferably comprises a superior base end 25 as illustrated in FIG. 5; an inferior base end 26 as illustrated in FIGS. 5 and 6; base end-joining structure 27 as illustrated in FIGS. 5 and 6; an opaque outer base surface 28 as illustrated and referenced in FIGS. 5 and 6; a matter-retaining inner base surface 29 as illustrated and referenced in FIG. 6; and base matter inlet-outlet means as generally referenced at 30 in FIG. 5. It is contemplated that weighted base member 24 may be constructed in a manner similar or the same as hide-behind structure 11 the inflatable bunker having an outer surface 31 and inner surface 33, inner surface 33 further defining base cavity 35. It is contemplated that analogous structural features of weighted base member 24 may be constructed using the same or similar materials as hide-behind structure 11, or different materials such as canvas, leather, or other resilient material that is water-proof and puncture resistant. In contradistinction to hide-behind structure 11, however, matter-retaining inner base surface 29 of weighted base member 24 is designed to receive matter of relatively greater mass as compared to the matter retained by matter-retaining inner bunker surface 16. In this regard, it is contemplated that matter-retaining inner base surface 29 of weighted base member 24 may be filled with water, sand or the like (as referenced at 32 in FIG. 5) through base matter inlet-outlet means 30, which means extend from outer base surface 28 to inner base surface 29.

It will be seen from an inspection of FIG. 5 that inferior bunker end 14 is cooperatively associated with superior base end 25. In this regard, it is contemplated that inferior bunker end 14 and superior base end 25 may be permanently or removably affixed to one another. In the latter respect, it is contemplated that inferior bunker end 14 may stack upon superior base end 25 and removably affixed thereto via mating VELCRO® brand hook and loop fastening means as generally depicted at 31 in FIG. 5. It is further contemplated, however, that other means may also be used to removably affix inferior bunker end 14 to superior base end 25. These alternative affixing means may include, but are not limited to, buckles and corresponding straps, snaps, buttons and slotted tabs, and the like.

As generally shown in FIG. 6, inferior bunker end 14 may be integrally formed with or permanently attached to superior base end 25. Thus, hide-behind bunker 10 (with weighted base member 24) may be formed as a single unit comprising two chambers (upper and lower chambers) separated by a dividing wall or internal diaphragm 33. As previously described, the upper chamber (defined by matter-retaining inner bunker surface 16) may preferably be air filled, while the lower chamber (defined by matter-retaining inner base surface 29) may be filled by a weighty material such as sand, water, wood chips, rubber, plastic shavings, top soil or like.

Figure 8:
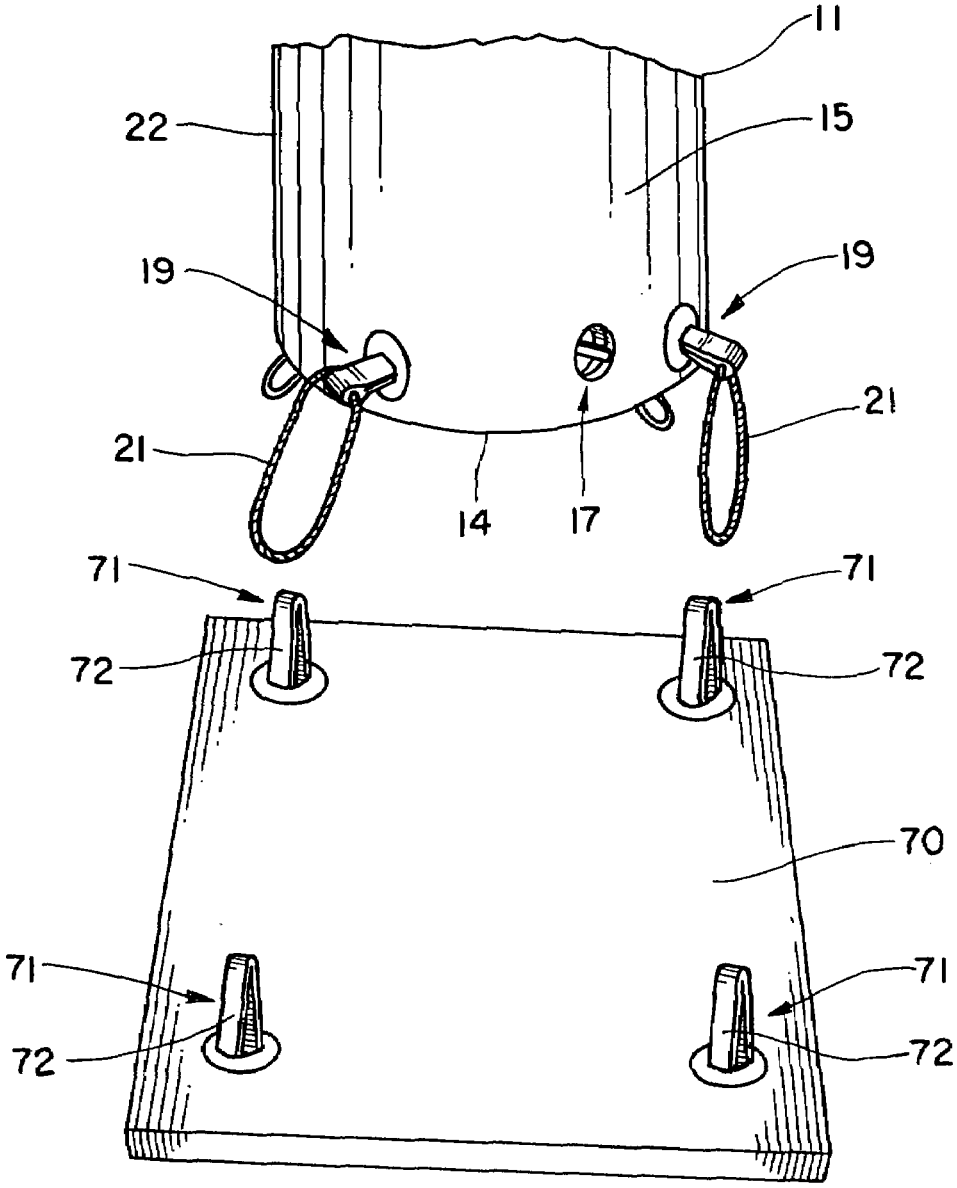
FIG. 8 is a fragmentary perspective view of a third alternative embodiment of the hide-behind bunker assembly.

Alternatively, hide-behind structure 11 may be anchored directly to a weighted planar base assembly 70 as generally shown in FIG. 8. Weighted planar base assembly 70 may comprise a number of planar base link assemblies 71. Each planar base link assembly preferably comprises a base loop 72, the longitudinal axes of which are substantially parallel to the longitudinal axes of respectively aligned loops 47 such that elastic link members 21 may relax in a planar state. Elastic link members 21 thus extend from loops 47 as earlier specified to respectively aligned base loops 72. Notably, planar base link assemblies 71 are substantially identical to bunker link assemblies 19 and thus base loops 72 are akin to loops 47. As with bunker link assemblies 19, planar base link assemblies 71 may either be integrally formed during the construction of weighted planar base assembly 70, or affixed thereto after weighted planar base assembly 70 has been partially or fully constructed.

In operation, the first step in setting up stand-alone, impact-dampening, sight-obstructing shield or hide-behind bunker 10 of the present invention is to inflate hide-behind structure 11. In this regard, bunker matter inlet-outlet means 17 is engaged or opened, and a motorized or manually operated air pump is directed thereto either directly or indirectly. Air is then introduced into the matter-receiving inner structure volume until the same is fully inflated to a predetermined pressure setting. As earlier specified, hide-behind structure 11 preferably comprises pressure relief means so as to avoid over-inflation and/or damage to hide-behind bunker 10. The air pump is the disconnected from the bunker matter inlet-outlet means 17 and the inlet-outlet means is otherwise disengaged or closed so as to prevent air from escaping out to the atmosphere via the inlet-outlet means 17.

Once fully inflated of filled, hide-behind structure 11 can either be used in an indoor arena or outdoor playing field. When used outdoors on a paintball, airsoft or projectile playing field, hide-behind structure 11 may be strategically placed on the field, and anchored to the ground by the described impact dampening anchor means.

During a paint pellet or a paintball match, players dodging paint pellets or paintballs on the playing field may seek cover behind strategically-placed hide-behind bunkers 10. Because hide-behind bunkers 10 are of stand-alone construction, players no longer risk the danger of tripping over feed tubes extending out from a manifold to continuously inflate or ventilate the bunkers. In the event that a player runs into a hide-behind bunker 10, hide-behind structure 11 will be displaced a given distance depending on the elasticity of elastic link member(s) 21. The elastic stretching motion of the described impact dampener absorbs much, if not all, of the force from the impact between the player and the bunker. Once the player moves away from the bunker, the bunker is then pulled into place by the recovering action of the elastic link member(s). In this manner, players can avoid serious bodily injury and focus their attention on playing the paintball war games or similar other sporting activity.

In another embodiment, hide-behind structure 11 may be anchored in place by weighted base member 24. Weighted base member 24 is constructed in similar fashion as hide-behind structure 11. Weighty material such as sand, water or the like is introduced into weighted base member 24 through base matter inlet-outlet means 30. Hide-behind structure 11 is then stacked on top of weighted base member 24, and may be removably affixed thereto by mating VELCRO® brand hook and loop fastening means located on inferior bunker end 14 and superior base end 25. Alternatively, hide-behind structure 11 may be fastened to weighted base member 24 using buckles and corresponding straps, mating snaps, buttons and slotted tabs and the like. In an alternative embodiment, hide-behind structure 11 and weighted base member 24 may be permanently affixed to one another as generally depicted in FIG. 6.

Figure 10:
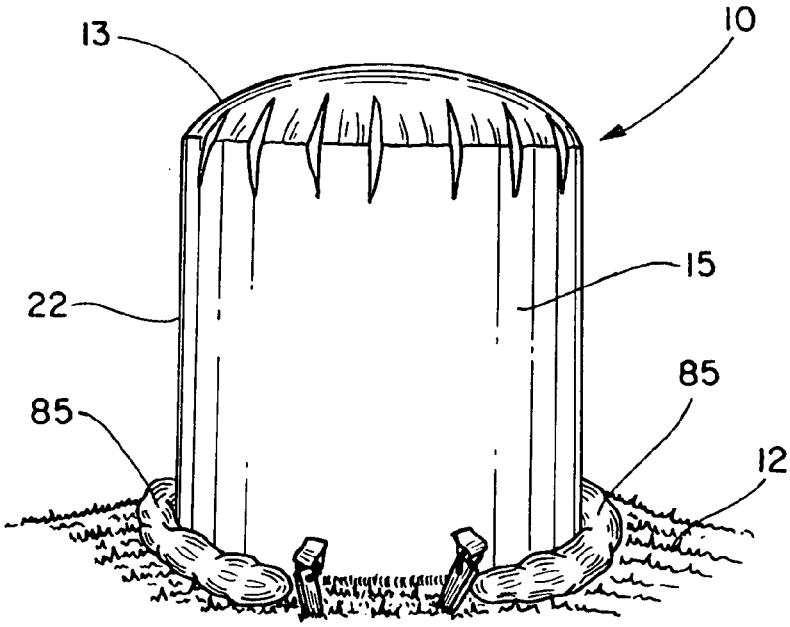
FIG. 10 is a perspective view of a fourth alternative embodiment of the hide-behind bunker assembly showing a plurality of weighting bags cooperatively associated with the impact dampening anchor system.

As yet a further embodiment of the invention, hide-behind structure 11 may be anchored by a plurality of weighting bags 85 or other massive structures (structures having sufficient anchoring mass when placed upon or adjacent certain structure) that can be connected to the impact dampening anchor means as generally shown in FIG. 10. In this embodiment of the invention, a hide-behind structure 11 that is fitted to be anchored to the ground by stakes can be retrofitted with weighting bags 85 attached to the impact dampening anchor means where it is more desirable to use weighting bags 85 as a means of securing the hide-behind structure 11 in a stationary place. This enables a hide-behind structure 11 of this type to be used in more situations.

In another embodiment, hide-behind structure 11 is anchored to weighted planar base assembly 70 by impact dampening anchor means. Elastic link member(s) 21 elastically connect bunker link assemblies 19 to planar base link assemblies 71 as generally shown in FIG. 8. The elastic link members 21 pass through loops 47 and base loops 72 thereby elastically connecting inflatable hide-behind structure 11 and weighted planar base assembly 70 together.

In this embodiment, players running into the indoor stand-alone bunker inadvertently can avoid serious bodily injury because, as discussed above, hide-behind structure 11 will travel a given distance depending on the elasticity of elastic link members 21. The stretching motion of the impact dampening anchor means absorbs much, if not all, of the force from the impact between the player and the bunker.

Once the game is completed, players may disassemble the stand-alone bunkers. The inlet-outlet means are engaged or opened to deflate the air filled bunker portion, and the weighty material is removed from weighted base member 24. Once emptied, hide-behind structure 11 and weighted base member 24 may be collapsed and packed into their respective containers for storage.

Figure 9:
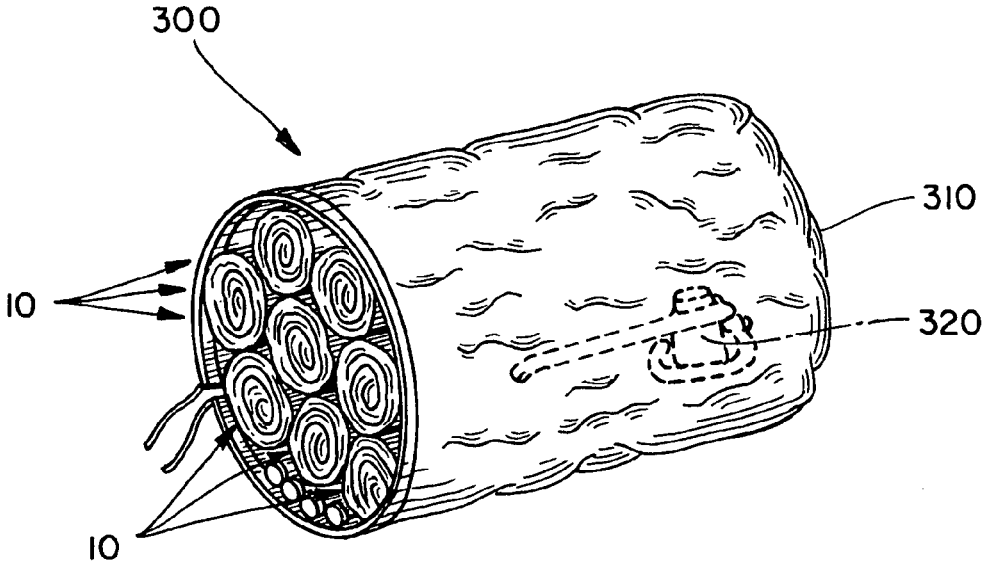
FIG. 9 is a perspective view of an obstacle field kit for enabling a user to create a diverse obstacle playing field.

As another aspect of the invention, a plurality of deflated hide-behind bunkers 10 can be used as an inflatable bunker playing field kit 300. In a kit 300 of the claimed invention, a container 310, such as the one shown in FIG. 9, can be used to hold a plurality of hide-behind bunkers 10, each having impact dampening anchoring means (including a plurality of stakes or weighting bags), and possibly a portable air blower 320 or other air inflation means for inflating hide-behind bunkers 10.

While the above description contains much specificity, this specificity should not be construed as limitations on the scope of the invention, but rather as an exemplification of the invention. For example, it is contemplated that the present invention essentially discloses a hide-behind bunker system for enabling a user to take cover behind at least one stand-alone, impact dampening structure. The hide behind bunker system comprises at least one hide-behind structure and certain impact dampening anchor means. Each hide-behind structure comprises a superior bunker end, an inferior bunker end, bunker end-joining structure, an opaque outer bunker surface, a matter-retaining inner bunker surface, and bunker matter inlet-outlet means. The bunker end-joining structure joins the superior bunker end to the inferior bunker end and comprises an inferior end transverse cross-section. The inferior end transverse cross-section comprises an inferior end periphery.

The inner bunker surface defines a matter-retaining inner structure volume for receiving and retaining structure-erecting matter (such as air, inert gas, or other volume filling matter as earlier described). The bunker matter inlet-outlet means extend from the outer bunker surface to the inner bunker surface for selectively inletting-outletting the structure-erecting matter. The impact dampening anchor means are attached to and extend outwardly from the outer bunker surface adjacent the inferior bunker end. The impact dampening anchor means and at least one hide-behind structure thus enable a user to take cover behind at least one stand-alone, impact dampening structure.

The impact dampening anchor means may be defined by a weighted base member comprising a superior base end, an inferior base end, base end-joining structure, an opaque outer base surface, a matter-retaining inner base surface, and base matter inlet-outlet means. The inner base surface is fillable with weighty matter through the base matter inlet-outlet means, which means extend from the outer base surface to the inner base surface. The inferior bunker end is cooperatively associated with the superior base end for providing the hide-behind bunker system with impact dampening anchor means. The inferior bunker end is cooperatively associated with the superior base end through a select affixation, the select affixation being selected from the group consisting of a permanent affixation or a temporary affixation. The temporary affixation is enabled by matable fastening means (such as VELCRO® brand hook and loop fastening means), the matable fastening means being cooperatively associated with the inferior bunker end and the superior base end.

The impact dampening anchor means may preferably be defined, however, by a plurality of elastic link anchor assemblies, each elastic link anchor assembly comprising a bunker link assembly, a playing surface link assembly, and a looped elastic link member. The elastic link member elastically links the bunker link assembly to the playing surface link assembly. Each bunker link assembly is attached to and extends outwardly from the outer bunker surface adjacent the inferior bunker end. Each bunker link assembly comprises a bunker link member (and preferably a bunker ring). The bunker link member inherently comprises a bunker link longitudinal axis. Each playing surface link assembly comprises an adapter body and playing surface attachment means. The adapter body comprises a proximal end region and a distal end region. The proximal end region comprises an adapter loop, which loop comprises an adapter loop longitudinal axis. The adapter loop longitudinal axis is substantially parallel to the bunker link longitudinal axis. The playing surface attachment means function to anchor the distal end region to a playing surface.

Each elastic link member is constructed from an elastic, impact dampening material and comprises a bunker loop-engaging portion, an anchor loop-engaging portion, and two laterally-opposed impact-absorbing lengths. The bunker loop-engaging portion passes through the bunker loop and the adapter loop-engaging portion passes through the adapter loop. Notably, the impact-absorbing lengths are preferably substantially coplanar with the loop-engaging portions (both the bunker and adapter loop-engaging portions) when the elastic link member is in a non-impact state or equilibrium state. The planar elastic link member is substantially parallel to the bunker loop longitudinal axis and the adapter loop longitudinal axis. The elastic link anchor assemblies thus form the impact dampening anchor means. The playing surface attachment means may be defined by a select anchor structure, the select anchor structure being selected from the group comprising at least one playing surface-piercing stake, at least one massive structure (such as weighted bags), and a weighted planar base assembly.

Lastly, the hide-behind bunker system may comprise a plurality of hide-behind structures, the hide-behind structures being selectively erectable and receivable in a kit container (when compacted). The hide-behind structures, when selectively erected, may further comprise a plurality of bunker shapes and bunker sizes, which variety of bunker shapes and bunker sizes function to enable users to create a diverse obstacle playing field. The kit container is preferably sized and shaped to contain at least eight selectively-erectable hide-behind structures, cooperatively associated impact dampening means, and structure-erecting means. The structure-erecting means are preferably defined by air inflation means and each selectively erectable hide-behind structure comprises air inlet-outlet means. The air inlet-outlet means may further comprise pressure relief means for releasing air from each selectively erectable hide-behind structure when internal air pressure of each selectively erectable hide-behind structure exceeds a predetermined pressure point.

Accordingly, although the invention has been described by reference to a preferred embodiment and a number of alternative embodiments, it is not intended that the novel system be limited thereby, but that modifications thereof are intended to be included as falling within the broad scope and spirit of the foregoing disclosure, the following claims and the appended drawings.

We claim:

1. An obstacle field kit, the obstacle field kit for enabling a user to create a diverse obstacle playing field, the diverse obstacle playing field comprising a plurality of stand-alone, impact dampening hide-behind structures, the obstacle field kit comprising:

a kit container, the kit container being sized and shaped to contain a plurality of compacted, selectively erectable hide-behind structures and impact dampening anchor means;

a plurality of compacted, selectively erectable hide-behind structures, each compacted, selectively erectable hide-behind structure being receivable in the kit container, the hide-behind structures, when selectively erected, comprising a plurality of bunker shapes and bunker sizes, the plurality of bunker shapes and bunker sizes for creating a diverse obstacle playing field;

impact dampening anchor means, the impact dampening anchor means comprising a plurality of elastic link anchor assemblies, each elastic link anchor assembly comprising a bunker link assembly, a playing surface link assembly, and an elastic link member, each bunker link assembly comprising a bunker link member and a bunker ring, each playing surface link assembly comprising an adapter body and playing surface-piercing stake; and structure-erecting means, the structure-erecting means for selectively erecting the compacted, selectively erectable hide-behind structures when removed from the kit container, the selectively erected hide-behind structures comprising a plurality of bunker shapes and bunker sizes, each selectively erected hide-behind structure comprising an inferior bunker end periphery, the selectively erected hide-behind structures for forming a diverse obstacle playing field.

2. The obstacle field kit of claim 1 wherein each of the selectively erected hide-behind structures is cooperatively associated with at least three elastic link anchor assemblies, the elastic link anchor assemblies being equally spaced about the inferior bunker end periphery, the cooperatively associated elastic link anchor assemblies providing each selectively erected hide-behind structure with impact dampening anchor means.

3. The obstacle field kit of claim 2 wherein the kit container is sized and shaped to contain at least eight compacted, selectively-erectable hide-behind structures, cooperatively associated impact dampening means, and structure-erecting means.

4. The obstacle field kit of claim 3 wherein the elastic link member is selected from the group consisting of a looped bungee cord, a looped elastic band, a looped rubber band, a looped spring member, or any combination thereof.

5. The obstacle field kit of claim 4 wherein the structure-erecting means is defined by air inflation means and each selectively erected hide-behind structure comprises air inlet-outlet means, the air inlet-outlet means comprising pressure relief means, the pressure relief means for releasing air from each selectively erected hide-behind structure when internal air pressure of each selectively erected hide-behind structure exceeds a predetermined pressure point.

6. A hide-behind bunker assembly, the hide-behind bunker assembly for enabling a user to take cover behind a stand-alone, impact dampening structure, the hide behind bunker assembly comprising:

a hide-behind structure and a plurality of elastic link anchor assemblies, the hide-behind structure comprising a superior bunker end, an inferior bunker end, bunker end-joining structure, an opaque outer bunker surface, a matter-retaining inner bunker surface, and air inlet-outlet means, the bunker end-joining structure integrally joining the superior bunker end to the inferior bunker end, the bunker end-joining structure comprising an inferior end transverse cross-section the inferior end transverse cross-section comprising an inferior end periphery, the inner bunker surface defining a matter-retaining inner structure volume, the inner structure volume for receiving and retaining air, the air inlet-outlet means extending from the outer bunker surface to the inner bunker surface for selectively inletting-outletting air, each elastic link anchor assembly comprising a bunker link assembly, a playing surface link assembly, and a looped elastic link member, the elastic link member elastically linking the bunker link assembly to the playing surface link assembly, each bunker link assembly being attached to and extending outwardly from the outer bunker surface, each bunker link assembly comprising a bunker link member and a bunker ring, the bunker link member comprising a bunker link longitudinal axis and the bunker ring comprising a bunker ring longitudinal axis, the bunker link longitudinal axis being substantially orthogonal to the bunker ring longitudinal axis, each playing surface link assembly comprising an adapter body and a playing surface-piercing stake, the adapter body comprising a proximal end region and a distal end region, the proximal end region comprising an adapter loop, the adapter loop comprising an adapter loop longitudinal axis, the adapter loop longitudinal axis being substantially parallel to the bunker link longitudinal axis, the distal end region comprising stake-receiving structure, the playing surface-piercing stake being receivable in the stake-receiving structure for anchoring the playing surface link assembly to a playing surface, each elastic link member being constructed from an elastic, impact dampening material, each elastic link member comprising a bunker loop-engaging portion, an anchor loop-engaging portion, and two laterally-opposed impact-absorbing lengths, the bunker loop-engaging portion passing through the bunker loop and the adapter loop-engaging portion passing through the adapter loop, the impact-absorbing lengths being substantially coplanar with the loop-engaging portions when the elastic link member is in a non-impact state, the planar elastic link member being substantially parallel to the bunker loop longitudinal axis and the adapter loop longitudinal axis, the elastic link anchor assemblies thus forming impact dampening anchor means, the impact dampening anchor means and the hide-behind structure thus enabling a user to take cover behind a stand-alone, impact dampening structure.

7. The hide-behind bunker assembly of claim 6 wherein the air inlet-outlet means comprise pressure relief means, the pressure relief means extending from the outer bunker surface to the inner bunker surface for relieving air pressure from the inner structure volume.

8. The hide behind bunker assembly of claim 7 wherein the outer bunker surface comprises an outer surface area and the inner bunker surface comprises an inner surface are, the outer surface area being substantially greater in magnitude than the inner surface area.

9. The hide-behind bunker assembly of claim 7 wherein the hide-behind structure is cooperatively associated with at least three elastic link anchor assemblies, the elastic link anchor assemblies being equally spaced adjacent the inferior end periphery.

10. A hide-behind bunker system, the hide-behind bunker system for enabling a user to take cover behind at least one stand-alone, impact dampening structure, the hide behind bunker system comprising at least one hide-behind structure and impact dampening anchor means, the hide-behind structure comprising a superior bunker end, an inferior bunker end, bunker end-joining structure, an opaque outer bunker surface, a matter-retaining inner bunker surface, and bunker matter inlet-outlet means, the bunker end-joining structure joining the superior bunker end to the inferior bunker end, the bunker end-joining structure comprising an inferior end transverse cross-section, the inferior end transverse cross-section comprising an inferior end periphery, the inner bunker surface defining a matter-retaining inner structure volume, the inner structure volume for receiving and retaining structure-erecting matter, the bunker matter inlet-outlet means extending from the outer bunker surface to the inner bunker surface for selectively inletting-outletting structure-erecting matter, the impact dampening anchor means being attached to and extending outwardly from the outer bunker surface adjacent the inferior bunker end, the impact dampening anchor means and at least one hide-behind structure thus enabling a user to take cover behind at least one stand-alone, impact dampening structure.

11. The hide-behind bunker system of claim 10 wherein the impact dampening anchor means is defined by a weighted base member, the weighted base member comprising a superior base end, an inferior base end, base end-joining structure, an opaque outer base surface, a matter-retaining inner base surface, and base matter inlet-outlet means, the inner base surface being fillable with weighty matter through the base matter inlet-outlet means, the base matter inlet-outlet means extending from the outer base surface to the inner base surface, the inferior bunker end being cooperatively associated with the superior base end for providing the hide-behind bunker system with impact dampening anchor means.

12. The hide-behind bunker system of claim 11 wherein the inferior bunker end is cooperatively associated with the superior base end through a select affixation, the select affixation being selected from the group consisting of a permanent affixation or a temporary affixation, the temporary affixation being enabled by matable fastening means, the matable fastening means being cooperatively associated with the inferior bunker end and the superior base end.

13. The hide-behind bunker system of claim 10 wherein the impact dampening anchor means are defined by a plurality of elastic link anchor assemblies, each elastic link anchor assembly comprising a bunker link assembly, a playing surface link assembly, and a looped elastic link member, the elastic link member elastically linking the bunker link assembly to the playing surface link assembly, each bunker link assembly being attached to and extending outwardly from the outer bunker surface adjacent the inferior bunker end, each bunker link assembly comprising a bunker link member, the bunker link member comprising a bunker link longitudinal axis, each playing surface link assembly comprising an adapter body and playing surface attachment means, the adapter body comprising a proximal end region and a distal end region, the proximal end region comprising an adapter loop, the adapter loop comprising an adapter loop longitudinal axis, the adapter loop longitudinal axis being substantially parallel to the bunker link longitudinal axis, the playing surface attachment means for anchoring the distal end region to a playing surface, each elastic link member being constructed from an elastic, impact dampening material, each elastic link member comprising a bunker loop-engaging portion, an anchor loop-engaging portion, and two laterally-opposed impact-absorbing lengths, the bunker loop-engaging portion passing through the bunker loop and the adapter loop-engaging portion passing through the adapter loop, the impact-absorbing lengths being substantially coplanar with the loop-engaging portions when the elastic link member is in a non-impact state, the planar elastic link member being substantially parallel to the bunker loop longitudinal axis and the adapter loop longitudinal axis, the elastic link anchor assemblies thus forming the impact dampening anchor means.

14. The hide-behind bunker system of claim 13 wherein the playing surface attachment means are defined by a select anchor structure, the select anchor structure being selected from the group comprising at least one playing surface-piercing stake, at least one massive structure, and a weighted planar base assembly.

15. The hide-behind bunker assembly of claim 10 wherein the bunker matter inlet-outlet means are defined by air inlet-outlet means and the matter-retaining inner structure volume receives and retains air, the air inlet-outlet means comprising pressure relief means, the pressure relief means extending from the outer bunker surface to the inner bunker surface for relieving air pressure from the inner structure volume.

16. The hide behind bunker assembly of claim 10 wherein the outer bunker surface comprises an outer surface area and the inner bunker surface comprises an inner surface are, the outer surface area being substantially greater in magnitude than the inner surface area.

17. The hide-behind bunker system of claim 10 wherein the hide-behind structure is cooperatively associated with at least three elastic link anchor assemblies, the elastic link anchor assemblies being equally spaced adjacent the inferior end periphery.

18. The hide-behind bunker system of claim 10 wherein hide-behind bunker system comprises a plurality of hide-behind structures, the hide-behind structures being selectively erectable and receivable in a kit container, the hide-behind structures, when selectively erected, comprising a plurality of bunker shapes and bunker sizes, the plurality of bunker shapes and bunker sizes for creating a diverse obstacle playing field.

19. The hide-behind bunker system of claim 18 wherein the kit container is sized and shaped to contain at least eight selectively-erectable hide-behind structures, cooperatively associated impact dampening means, and structure-erecting means.

20. The hide-behind bunker system of claim 19 wherein the structure-erecting means is defined by air inflation means and each selectively erectable hide-behind structure comprises air inlet-outlet means, the air inlet-outlet means comprising pressure relief means, the pressure relief means for releasing air from each selectively erectable hide-behind structure when internal air pressure of each selectively erectable hide-behind structure exceeds a predetermined pressure point.

* * * * *